US005093305A

United States Patent [19]

Hiraishi et al.

[11] Patent Number: 5,093,305

[45] Date of Patent: Mar. 3, 1992

[54] HEAT-SENSITIVE RECORDING MATERIAL

[75] Inventors: Shigetoshi Hiraishi; Susumu Yamanobe; Yutaka Shimura, all of Tokyo, Japan

[73] Assignee: Mitsubishi Paper Mills Limited, Tokyo, Japan

[21] Appl. No.: 414,256

[22] Filed: Sep. 29, 1989

[30] Foreign Application Priority Data

Sep. 30, 1988 [JP] Japan ..... 63-248845

[51] Int. Cl.[5] ..... B41M 5/30

[52] U.S. Cl. ..... 503/209; 503/217

[58] Field of Search ..... 503/208, 209, 216-218, 503/225

[56] References Cited

U.S. PATENT DOCUMENTS 4,521,793 6/1985 Kabashima et al. ..... 503/201

*Primary Examiner*—Bruce H. Hess

*Attorney, Agent, or Firm*—Cushman, Darby & Cushman

[57] ABSTRACT

There is disclosed a heat sensitive recording material comprising a color-forming agent consisting of an aromatic isocyanate compound and an imino compound, and a phenol compound; said recoridng material being excellent in storability of image and storability of non-image area as well.

6 Claims, No Drawings

HEAT-SENSITIVE RECORDING MATERIAL

BACKGROUND OF THE INVENTION

1. Field of the Invention

This invention relates to a heat-sensitive recording material excellent in storage stabilities of image area and uncolored area produced by providing a specified heat-sensitive recording layer on a support.

2. Prior Art

Heat-sensitive recording materials are generally produced by providing a heat-sensitive recording layer composed mainly of an electron-donative colorless dye precursor and an electron-acceptive color developing agent on a support. When it is heated by means of thermal head, thermal pen, laser light or the like, the colorless dye precursor and the color developing agent instantaneously react to form a record image. They are disclosed in Japanese Patent Publication No. 43-4,160, Japanese Patent Publication No. 45-14,039, etc. This type of heat-sensitive recording materials are advantageous in that they can make a record with a relatively simple apparatus, their maintenance is easy to practice, and they emit no noises. Thus, they are utilized in wide fields such as recorders for measurements, facsimiles, printers, computer terminals, labels, ticket vending machines and the like.

Although this type of heat-sensitive recording materials using an electron-donative colorless dye precursor and an electron-acceptive color developing agent have many excellent properties such as good appearance, good touch, high optical density of developed color, diversity in the hue of developed color, and so on, they are disadvantageous because of poor storage stability of image. For example, if the record image area is contacted with a plastic material such as polyvinyl chloride, it disappears due to the action of plasticizer or other additives present in the plastic material, or it readily disappears upon contact with the chemicals used in foodstuffs or cosmetics, or it readily disappears when exposed to sunlight only for a short period of time. Because of this disadvantage, their use is limited at the present stage, and their improvement in this point is intensely desired.

As heat-sensitive recording material wherein two components mutually react upon heating to form a record image of good storage stability, heat-sensitive recording materials wherein the two components consist of an imino compound and an isocyanate compound are disclosed in, for example, Japanese Patent Application Kokai (Laid-Open) Nos. 58-38,733, 58-54,085, 58-104,959, 58-149,388, 59-115,887 and 59-115,888, as well as in U.S. Pat. No. 4,521,793.

Although the heat-sensitive recording materials excellent in record storability consisting of an isocyanate compound and an imino compound are excellent in record storability of image, they are disadvantageous in that the non-image area (ground area) can be colored when contacted with plasticizer or the like.

SUMMARY OF THE INVENTION

With the aim of obtaining a heat-sensitive recording material excellent in storability of image and at the same time in the storability of non-image area, the present inventors conducted many studies. As the result, it was found that a heat-sensitive recording material consisting of an aromatic isocyanate compound and an imino compound of which properties are so excellent in the above-mentioned points as unachievable according to the prior color-forming systems only can be obtained by incorporating at least one phenol compound represented by the following general formula (I):

$$H\text{-}(CHR_1)_l\text{-}(CHR_2)_m\text{-}(CHR_3)_n\text{-}R_4 \qquad (I)$$

(in this formula, $R_1$, $R_2$ and $R_3$ each represents

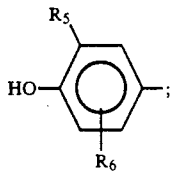

;

$R_4$ represents hydrogen or alkyl group having 1 to 8 carbon atoms;

$R_5$ represents alkyl group having 3 to 8 carbon atoms, cyclohexyl group or phenyl group; $R_6$ represents hydrogen or alkyl group having 1 to 8 carbon atoms; and l, m and n each represents an integer of 0, 1 or 2; provided that l, m and n cannot simultaneously represent 0) into a heat-sensitive recording material consisting of an aromatic isocyanate compound and an imino compound. Based on this finding, this invention was accomplished.

DETAILED DESCRIPTION OF PREFERRED EMBODIMENTS

The phenol compound of this invention is a hindered phenol derivative. It preferably has substituent(s) on at least one ortho position(s) with regard to the phenolic hydroxyl group, and more preferably has plural phenol groups in one molecule. Concrete examples of said phenol compound include the followings:

1,1,3-tris(3-tert-butyl-4-hydroxy-6-methyl-phenyl)butane,
1,1,3-tris(3-tert-butyl-4-hydroxy-6-ethyl-phenyl)butane,
1,1,3-tris(3,5-di-t-butyl-4-hydroxyphenyl)-butane,
1,1,3-tris(3-tert-butyl-4-hydroxy-6-methyl-phenyl)propane,
1,2,3-tris(3-tert-butyl-4-hydroxy-6-methyl-phenyl)butane,
1,1,3-tris(3-phenyl-4-hydroxyphenyl)butane,
1,1,3-tris(3-cyclohexyl-4-hydroxy-5-methyl-phenyl)butane,
1,1,3-tris(3-cyclohexyl-4-hydroxy-6-methyl-phenyl)butane,
1,1,3,3-tetra(3-phenyl-4-hydroxyphenyl)-propane,
1,1,3,3-tetra(3-cyclohexyl-4-hydroxy-6-methyl-phenyl)-propane,
1,1-bis(3-tert-butyl-4-hydroxy-6-methyl-phenyl)butane,
1,1-bis(3-cyclohexyl-4-hydroxy-6-methyl-phenyl)butane, and the like.

The use of these compounds in a heat-sensitive recording material using a color-forming reaction system consisting of an electron-donative dye (the so-called leuco dye) and an electron-acceptive compound (organic acid or phenolic compound) is disclosed in Japanese Patent Application Kokai (Laid-Open) Nos. 58-57,990, 59-2,884, 61-44,686 and 62-169,683. There is disclosed in these patent specifications that storability of colored image can be improved by incorporating these compounds into said heat-sensitive recording material, that bisphenol type compounds having two phenol groups in one molecule are inferior in this effect and triphenol type compounds having three phenol groups in one molecule are effective, and that a phenomenon of fogging (a gradual coloration of ground) is observed. This suggests that the phenol compounds disclosed therein are also weakly electron-acceptive so that they can develop a color from leuco dyes. It has been found that, if these phenol compounds are used in the heat-sensitive recording material of this invention using a color-forming reaction system consisting of an isocyanate compound and an imino compound, no particularly effect is exhibited on the storability of colored image but a marked effect is exhibited on the prevention of fogging of ground. With regard to this effect, there is no noticeable different between bisphenol type phenol compounds and triphenol type phenol compounds. This is an effect by no means expectable from the behavior of prior color-forming reaction systems using leuco dyes.

In this invention, the phenol compound represented by general formula (I) is used in an amount of 3 to 300% by weight and preferably 10 to 200% by weight, both based on the weight of aromatic isocyanate compound.

As used herein, the term "aromatic isocyanate compound" inclusively means colorless or light-colored aromatic isocyanate compounds and heterocyclic isocyanate compounds which are solid at ordinary temperature. It includes the compounds disclosed in U.S. Pat. No. 4,521,793. For example, at least one member selected from the following isocyanate compounds is(are) used in this invention:

2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene- 2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene--1,4 diisocyanate, 2,5-diethoxybenzene-1,4-diisocyanate, 2,5-dibutoxybenzene-1,4-diisocyanate, azobenzene-4,4'-diisocyanate, (diphenyl ether)-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4''-triisocyanato-2,5-di-methoxytriphenylamine, p-dimethylaminophenyl isocyanate, tris(4-phenylisocyanato) thiophosphate, and the like. If desired, these isocyanates may be used in the form of the so-called blocked isocyanate, i.e. adduct with phenol, lactam, oxime and the like. Otherwise, they may also be used in the form of diisocyanate dimer, such as 1-methylbenzene-2,4-diisocyanate dimer, or in the form of an isocyanurate which is trimer of isocyanate. Furthermore, it is also possible to use them in the form of a polyisocyanate which is adduct formed between isocyanate and a polyol.

As used herein, the term "imino compound" inclusively means compounds colorless or light-colored, solid at ordinary temperature, having at least one >C=NH group, and represented by the following general formula:

$$\Phi C{=}NH$$

($\Phi$ represents an aromatic compound residue capable of forming a conjugated system in conjunction with adjacent C=N). It includes those disclosed in U.S. Pat. No. 4,521,793. Concrete examples of said imino compound include the followings, provided that two or more species of imino compounds may be used in combination in accordance with purpose:

3-iminoisoindolin-1-one, 3-imino-4,5,6,7-tetrachlorisoindolin-1-one, 3-imino-4,5,6,7-tetrabromisoindolin-1-one, 3-imino-4,5,6,7-tetrafluorisoindolin-1-one, 3-imino-5,6-dichlorisoindolin-1-one, 3-imino-4,5,7-trichloro-6-methoxyisoindolin-1-one, 3-imino-4,5,7-trichloro-6-methylmercaptoisoindolin-1-one, 3-imino-6-nitroisoindolin-1-one, 3-iminoisoindolin-1-spiro-dioxolan, 1,1-dimethoxy-3-iminoisoindoline, 1,1-diethoxy-3-imino-4,5,6,7-tetrachlorisoindoline, 1-ethoxy-3-iminoisoindoline, 1,3-diiminoisoindoline, 1,3-diimino-4,5,6,7-tetrachlorisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, iminoisoindoline, 1-(2'-chloro-5'-trifluoromethyl-phenylimino)-3-iminoisoindoline, 1-(5',6'-dichlorobenzo-thiazolyl-2'-imino)-3-iminoisoindoline, 1-(6'-methyl-benzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino}-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyrazisoindoline, 1-(cyanobenzoylmethylene)-3-iminoisoindoline, 1-(cyanocarbonamidomethylene)-3-iminoisoindoline, 1-(cyanocarbmethoxymethylene)-3-iminoisoindoline, 1-(cyanocarbethoxymethylene)-3-iminoisoindoline, 1-cyano-N-phenylcarbamoylmethylene)-3-iminoisoindoline, 1-[cyano-N-(3'-methylphenyl)-carbamoylmethylen]-3-iminoisoindoline, 1-[cyano-N-(4'-chlorophenyl)-carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazolyl-(2'-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachlorisoindoline, 1-[(cyanobenzimidazolyl-2')-methylene]-3-imino-5-methoxy-isoindoline, 1-[(cyanobenzimidazolyl-2')-methylene]-3-imino-6-chlorisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino5,6-dimethyl-4,7-pyrazisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, 3-imino-2-methyl-4,5,6,7-tetrachlorisoindolin-1-one, and the like.

In the heat-sensitive recording material of this invention, a heat-sensitive recording layer capable of developing color upon heating is provided on a support, as has been mentioned above. Though paper is mainly used as the support, various unwoven fabrics, synthetic resin films, laminated papers, synthetic papers, metallic foils and the like or composite sheets prepared by combining them can also be used arbitrarily apart from paper, in accordance with purpose. The heat sensitive layer may be constructed of a single layer or plural layers (multi-layer structure). In case of multi-layer structure, intermediate layers may be provided between the layers, and a protective layer may be provided on these layers. The recording layer can be prepared by finely pulverizing the color-forming components to prepare their respective aqueous dispersions, mixing the dispersions with a binder or the like, coating the mixtures onto a support, and drying them. It is also possible to make a multi-layer structure by incorporating one color-forming component into each layer.

In order to improve its thermal response, the heat-sensitive recording material of this invention may contain a thermally fusible substance. As said thermally fusible substance, substances having a melting point of 60° C. to 180° C. are preferable, and those having a melting point of 80° C. to 140° C. are particularly preferable. Examples of said thermally fusible substance include benzyl p-benzyloxybenzoate, stearic acid amide, palmitic acid amide, N-methylolstearic acid amide, β-naphthyl benzyl ether, N-stearylurea, N,N'-distearylurea, phenyl β-naphthoate, phenyl 1-hydroxy-2-naphthoate, β-naphthol p-methylbenzyl ether, 1,4-dimethoxynaphthalene, 1-methoxy-4-benzyloxynaphthalene, N-stearoylurea, 4-benzylbiphenyl, 1,2-di(m-methylphenoxy)-ethane, 1-phenoxy-2-(4-chlorophenoxy)-ethane, 1,4-butanediol phenyl ether, dimethyl terephthalate, and the like.

Said thermally fusible substance may be used either as a single substance or in the form of a mixture. In order to achieve a sufficient heat responsibility, it is used preferably in an amount of 10 to 300% by weight and more preferably in an amount of 20 to 250% by weight, based on the weight of aromatic isocyanate.

The heat-sensitive recording material of this invention may further contain an aniline derivative having at least one amino group disclosed in PCT/JP81/00300 of the present inventors, by which the fogging of ground can be prevented more effectively. Furthermore, its effect can additionally be improved by using it in combination with a phenol compound of this invention. As said aniline derivatives having at least one amino group, the followings can be referred to: methyl p-aminobenzoate, ethyl p-aminobenzoate, n-propyl p-aminobenzoate, isopropyl p-aminobenzoate, butyl p-aminobenzoate, dodecyl p-aminobenzoate, benzyl p-aminobenzoate, p-aminobenzophenone, m-aminoacetophenone, p-aminoacetophenone, m-aminobenzamide, o-aminobenzamide, p-aminobenzamide, p-amino-N-methylbenzamide, 3-amino-4-chlorobenzamide, p-(N-phenylcarbamoyl)-aniline, p-[N-(4-chlorophenyl)-carbamoyl]-aniline, p-[N-(4-aminophenyl)-carbamoyl]-aniline, 2-methoxy-5-(N-phenylcarbamoyl)-aniline, 2-methoxy-5-[N-(2'-methyl-3'-chlorophenyl)-carbamoyl]-aniline, 2-methoxy-5-[N-(2'-chlorophenyl)-carbamoyl]-aniline, 5-acetylamino-2-methoxyaniline, 4-acetylaminoaniline, 4-(N-methyl-N-acetylamino)-aniline, 2,5-diethoxy-4-(N-benzoylamino)-aniline, 2,5-dimethoxy-4-(N-benzoylamino)-aniline, 2-methoxy-4-(N-benzoyl-amino)-5-methylaniline, 4-sulfamoylaniline, 3-sulfamoylaniline, 2-(N-ethyl-N-phenylaminosulfonyl)-aniline, 4-dimethylaminosulfonylaniline, 4-diethylaminosulfonylaniline, sulfathiazole, 4-aminodiphenyl-sulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonyl-aniline, 2-phenoxysulfonylaniline, 2-(2'-chlorophenoxy)-sulfonylaniline, 3-anilinosulfonyl-4-methylaniline, bis[4-(m-aminophenoxy)-phenyl] sulfone, bis[4-(p-aminophenoxy)-phenyl] sulfone, bis[3-methyl-4-(p-aminophenoxy)-phenyl] sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolydine sulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl) sulfone, bis(3,4-diaminophenyl) sulfone, bis(4-aminophenyl) sulfone, bis(3-aminophenyl) sulfone, 3,4'-diaminodiphenyl sulfone, 3,3'-diaminodiphenylmethane, 4,4'-ethylenedianiline, 4,4'-diamino-2,2'-dimethylbibenzyl, 4,4'-diamino-3,3'-dichlorodiphenylmethane, 3,3'-diaminobenzophenone, 4,4'-diaminobenzophenone, 1,4-bis(4-aminophenoxy)-benzene, 1,3-bis(4-aminophenoxy)-benzene, 1,3-bis(3-aminophenoxy)-benzene, 9,9-bis(4-aminophenyl)-fluorene, 2,2-bis(4-aminophenoxyphenyl)-propane, 4,4'-bis(4-aminophenoxy)-diphenyl, 3,3',4,4'-tetraaminodiphenyl ether, 3,3',4,4'-tetraaminodiphenyl sulfone, 3,3',4,4'-tetraaminobenzophenone, and the like.

The binders which can be used in the heat-sensitive recording material of this invention include water-soluble binders such as starches, hydroxyethyl cellulose, methyl cellulose, carboxymethyl cellulose, gelatine, casein, polyvinyl alcohol, modified polyvinyl alcohol, styrene-maleic anhydride copolymer, ethylene-maleic anhydride copolymer and the like; and latex type water-insoluble binders such as styrene-butadiene copolymer, acrylonitrile-butadiene copolymer, methyl acrylate-butadiene copolymer and the like.

Into the heat-sensitive recording layer, pigments such as diatomaceous earth, talc, kaolinite, calcined kaolinite, calcium carbonate, magnesium carbonate, titanium oxide, zinc oxide, silicon oxide, aluminum hydroxide, urea-formaldehyde resin and the like may be incorporated. Apart from the above, higher fatty acid metallic salts such as zinc stearate, calcium stearate and the like and waxes such as paraffin, paraffin oxide, polyethylene, oxidized polyethylene, stearic acid amide, caster wax and the like may be added for the purpose of preventing the abrasion of head and the sticking. Furthermore, dispersants such as sodium dioctyl sulfosuccinate and the like, benzophenone type or benzotriazole type ultraviolet absorbers, surfactants, fluorescent dyes, etc. may also be added.

Next, this invention will be explained in more detail by way of the following examples.

EXAMPLE 1

Fifteen grams of 1,3-diimino-4,5,6,7-tetrachlorisoindoline was dispersed together with 60 g of 1% aqueous solution of polyvinyl alcohol in a ball mill for 24 hours. Apart from it, 10 g of 4,4',4''-triisocyanato-2,5-dimethoxytriphenylamine was dispersed together with 40 g of 1% aqueous solution of polyvinyl alcohol in a ball mill for 24 hours to prepare a dispersion. Apart from them, 15 g of 2-methoxy-5-N,N-diethylsulfamoylaniline was similarly dispersed together with 60 g of 2.5% aqueous solution of polyvinyl alcohol and 20 g of 1,1,3-tris(3-tert-butyl-4-hydroxy-6-methylphenyl)-butane was similarly dispersed together with 80 g of 2.5% aqueous solution of polyvinyl alcohol to prepare respective dispersions. After mixing together these four dispersions, 200 g of 40% aqueous dispersion of calcium carbonate, 50 g of 30% aqueous dispersion of zinc stearate, 300 g of 10% aqueous solution of polyvinyl alcohol and 130 g of water were added and thoroughly stirred to prepare a coating fluid. The coating fluid was coated onto a base paper having a basis weight of 50 g/m$^2$ so as to give a coating weight of 7.6 g/m$^2$ (weight of solid component) and dried, after which it was treated with a super calender to obtain a heat sensitive recording material.

EXAMPLE 2

A heat-sensitive recording material was prepared by repeating the procedure of Example 1, except that the 1,1,3-tris(3-tert-butyl-4-hydroxy-6-methylphenyl)-butane was replaced with 1,1,3-tris(3-cyclohexyl-4-hydroxy-6-methylphenyl)-butane.

EXAMPLE 3

A heat-sensitive recording material was prepared by repeating the procedure of Example 1, except that the 1,1,3-tris(3-tert-butyl-4-hydroxy-6-methylphenyl)-butane was replaced with 1,1-bis(3-tert-butyl-4-hydroxy-6-methylphenyl)-butane.

COMPARATIVE EXAMPLE 1

A heat-sensitive recording material was prepared by repeating the procedure of Example 1, except that the 1,1,3-tris(3-tert-butyl-4-hydroxy-6-methylphenyl)-butane was not used and the coating weight was adjusted to 6.7 g/m$^2$ as expressed by the weight of solid component.

Test 1

(Optical density of developed color)

Each of the heat-sensitive recording materials obtained in Examples 1 to 3 and Comparative Example 1 was printed by means of a heat-sensitive facsimile printing tester at an input pulse of 1.0 milli-second, at an input voltage of 11.00 volts. The optical density of developed image was measured with Macbeth Densitometer RD918. The results are shown in Table 1.

Test 2

(Plasticizer resistance)

Each of the heat-sensitive recording materials obtained in Examples 1 to 3 and Comparative Example 1 was superposed on a polyvinyl chloride sheet and allowed to stand under a load of 300 g/cm$^2$ for 24 hours in an atmosphere of 40° C. Then, the optical densities of colored area and uncolored area were measured in the same manner as in Test 1. The results were as shown in Table 1. In Table 1, a smaller optical density in uncolored area means a smaller extent of fogging in ground, or a better result.

Test 3

(Oil resistance)

In each of the heat-sensitive recording materials obtained in Examples 1 to 3 and Comparative Example 1, the printed surface was uniformly coated with a salad oil by means of a coating rod and allowed to stand for 24 hours in an atmosphere of 40° C., after which the optical densities of colored and uncolored areas were measured in the same manner as in Test 1 to obtain the results shown in Table 1. Similarly to Test 2, a smaller optical density in uncolored area means a smaller extent of fogging in ground, or a better result.

TABLE 1

| | Test 1 | | Test 2 | | Test 3 | |
|---|---|---|---|---|---|---|
| | Colored area | Ground | Colored area | Ground | Colored area | Ground |
| Example 1 | 0.59 | 0.06 | 0.61 | 0.09 | 0.70 | 0.14 |
| Example 2 | 0.60 | 0.06 | 0.62 | 0.11 | 0.71 | 0.15 |
| Example 3 | 0.63 | 0.05 | 0.66 | 0.10 | 0.70 | 0.17 |
| Comparative Example 1 | 0.59 | 0.05 | 0.61 | 0.16 | 0.70 | 0.24 |

As seen above, heat-sensitive recording materials excellent in storage stabilities of image area and non-image area could be obtained by using the phenol compound of this invention.

What is claimed is:

1. A heat-sensitive recording material comprising at least one phenol compound represented by the following general formula (I):

$$H\text{-}(CHR_1)_l\text{-}(CHR_2)_m\text{-}(CHR_3)_n\text{-}R_4 \quad (I)$$

(in this formula, $R_1$, $R_2$ and $R_3$ each represents

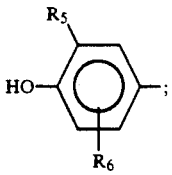

;

$R_4$ represents hydrogen or alkyl group having 1 to 8 carbon atoms; $R_5$ represents alkyl group having 3 to 8 carbon atoms, cyclohexyl group or phenyl group; $R_6$ represents hydrogen or alkyl group having 1 to 8 carbon atoms; and l, m and n each represents an integer of 0, 1 or 2, provided that l, m and n cannot simultaneously represent 0) and a color-forming agent consisting of an aromatic isocyanate compound and an imino compound.

2. A heat-sensitive recording material according to claim 1, wherein an aniline derivative having at least one amino group is further contained.

3. A heat-sensitive recording material according to claim 1, wherein said phenol compound is a hindered phenol derivative having substituent(s) on at least one ortho position(s) with regard to the phenolic hydroxyl group.

4. A heat-sensitive recording material according to claim 1, wherein said phenol compound is added in an amount of 3 to 300% by weight based on the weight of the aromatic isocyanate compound.

5. A heat-sensitive recording material according to claim 1, wherein said phenol compound is added in an amount of 10 to 100% by weight based on the weight of the aromatic isocyanate compound.

6. A heat-sensitive recording material according to claim 1 which additionally comprises a thermally fusible substance.

* * * * *